US008137118B2

(12) United States Patent
Pearson et al.

(10) Patent No.: US 8,137,118 B2
(45) Date of Patent: Mar. 20, 2012

(54) ARMORED ELECTRICAL CONNECTOR

(76) Inventors: Dennis Pearson, Foothill Ranch, CA (US); Guang Jin, Santa Monica, CA (US)

( * ) Notice: Subject to any disclaimer, the term of this patent is extended or adjusted under 35 U.S.C. 154(b) by 93 days.

(21) Appl. No.: 12/722,440

(22) Filed: Mar. 11, 2010

(65) Prior Publication Data

US 2011/0223783 A1 Sep. 15, 2011

(51) Int. Cl.
*H01R 4/66* (2006.01)

(52) U.S. Cl. ..... 439/101; 439/607.05

(58) Field of Classification Search ..... 439/95, 439/101–108, 607.04, 607.05
See application file for complete search history.

(56) References Cited

U.S. PATENT DOCUMENTS 5,436,816 A * 7/1995 Nagano ..... 362/219
7,575,476 B2 * 8/2009 Tyler et al. ..... 439/607.04
7,878,868 B2 * 2/2011 Mech et al. ..... 439/709
7,918,673 B1 * 4/2011 Mimura et al. ..... 439/101

* cited by examiner

*Primary Examiner* — Khiem Nguyen
(74) *Attorney, Agent, or Firm* — Greenberg Traurig, LLP; Franklin D. Ubell

(57) ABSTRACT

An electrical connector which facilitates electrical interconnection of adjacent lighting fixtures and includes a female connector half and male connector half, each having first and second horizontally disposed passageways formed therein. The male connector half further has a male ground pin positioned to mate with a female ground slot formed in the female connector half. A female insert is positioned in each of the passageways of the female connector half and has an interior shaped and dimensioned to receive and retain a male electrical connector pin while a male insert is positioned in each passageway of the male connector half and has an interior shaped and dimensioned to receive and retain a female electrical connector pin. The connector and ground pins are so positioned that a ground connection is established prior to the establishment of electrical continuity between the connector pins when the male connector half is "plugged into" the female connector half.

30 Claims, 7 Drawing Sheets

ARMORED ELECTRICAL CONNECTOR

BACKGROUND

1. Field

The subject disclosure relates to electrical connectors and more specifically to an armored electrical connector for establishing electrical conductivity between adjacent electric lighting fixtures.

2. Related Art

Modular electric lighting fixtures which are interconnectable together are disclosed in U.S. patent application Ser. No. 12/130,882 filed May 30, 2008, now U.S. Pat. No. 7,726,840 B2. In such fixtures, there is a need to conduct electrical power between adjacent fixtures.

SUMMARY

The following is a summary description of an illustrative embodiment of the invention. It is provided as a preface to assist those skilled in the art to more rapidly assimilate the detailed design discussion which ensues and is not intended in any way to limit the scope of the claims which are appended hereto in order to particularly point out the invention.

An electrical connector which facilitates electrical interconnection of adjacent lighting fixtures according to an illustrative embodiment comprises a female connector half having first and second horizontally disposed passageways formed therein; and a male connector half having first and second horizontally disposed passageways formed therein. The first and second passageways of the female connector half are aligned with a respective one of the first and second passageways of the male connector half so as to form first and second continuous passageways through the male and female connector halves when the two halves are mated together. The male connector half further has a male ground pin positioned to mate with a female ground slot formed in the female connector half.

Further according to an illustrative embodiment, a first female insert is positioned in each of the passageways of the female connector half, each first female insert having an interior shaped and dimensioned to receive and retain a male electrical connector pin. A first male insert is positioned in each passageway of the male connector half and has an interior shaped and dimensioned to receive and retain a female electrical connector pin. Each male insert also has a cylindrical projection which inserts into and mates with a respective female insert when the first male connector half mates with the female connector half. The male and female connector pins are so positioned in their respective inserts that they interconnect to establish electrical continuity when the male connector half mates with or is "plugged into" the female connector half.

DRAWINGS

DETAILED DESCRIPTION

Figure 1:
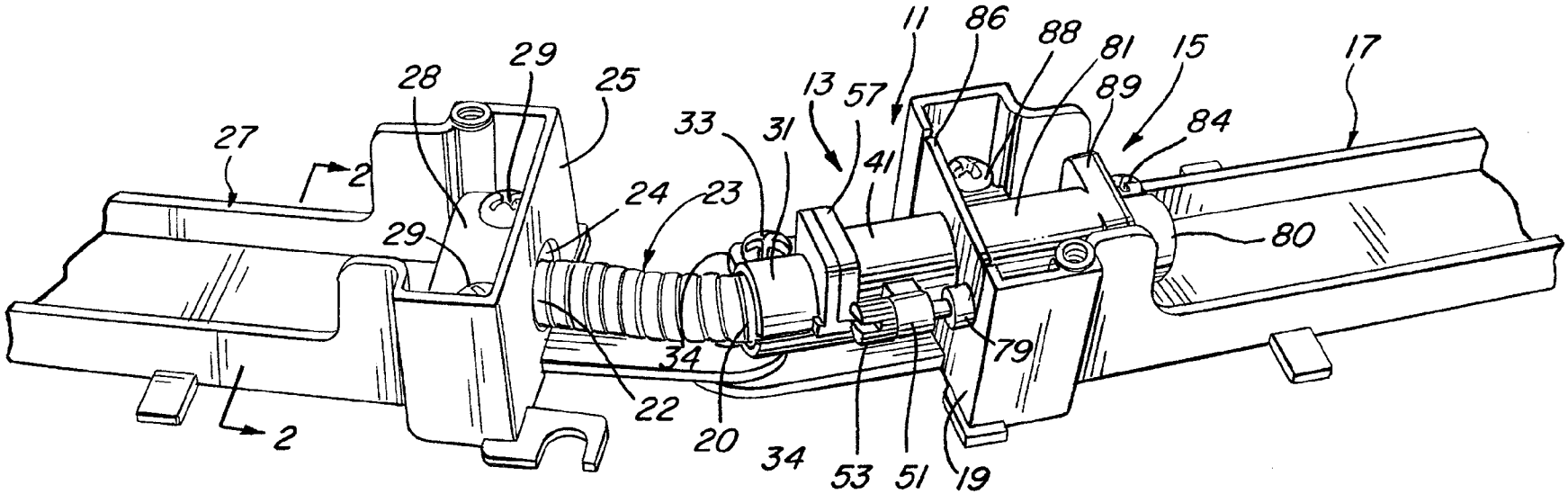
FIG. 1 is a perspective view illustrating an electrical connector according to an illustrative embodiment fixed in position in a base of an electrical lighting fixture.

An armored electrical connector 11 according to an illustrative embodiment is shown in FIGS. 1-9. The connector 11 includes a male connector half 13 and a female connector half 15. In one illustrative embodiment, each connector half 13, 15 is preferably a unitary, single piece component fabricated of zinc or aluminum although other materials may be used.

The male connector half 13 has a receptacle 18 (FIG. 3) of semicircular contour positioned at its front end, which receives a first end 20 of an electrical conduit 23. The first end 20 of the conduit 23 is held in place in the receptacle 18 by a cover or conduit clamp 31, which is attached by a screw 33 threadably attached through a hole 36 in an extended front portion 34 of the male connector half 13. Tightening down the screw 33 clamps the conduit 23 in position in the male connector half 13. In such position, the cover 31 shields the electrical leads, e.g. 201, 203 shown in FIG. 8, which pass out of the conduit 23 and into two respective passageways 43, 45 (FIG. 3) in the male connector half 13. In one embodiment, the circular opening in each of these passageways 43, 45 has the same diameter.

Figure 2:
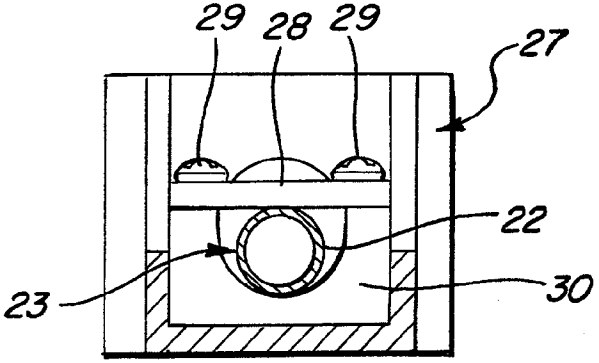
FIG. 2 is a sectional view of a second light fixture base taken at 2-2 of FIG. 1.

In the illustrative embodiment of FIG. 1, the second end 22 of the electrical conduit 23 passes through an opening 24 in a first end 25 of a second lighting fixture base 27 and is clamped in place within the base 27 by a rectangular bar 28 which is attached by screws 29 to a clamp base 30, as shown in FIG. 2. Thus, electrical wires or leads attached to componentry within the first base 27 may pass through the conduit 23 and be joined to contact pins located within the male connector half 13, as described in more detail hereafter.

In one embodiment, the lighting fixture base units 17, 27 may be base units of modular lighting fixtures such as those disclosed in co-pending U.S. patent application Ser. No. 12/130,882, now U.S. Pat. No. 7,726,840 B2, incorporated by reference in its entirety herein.

Figure 3:
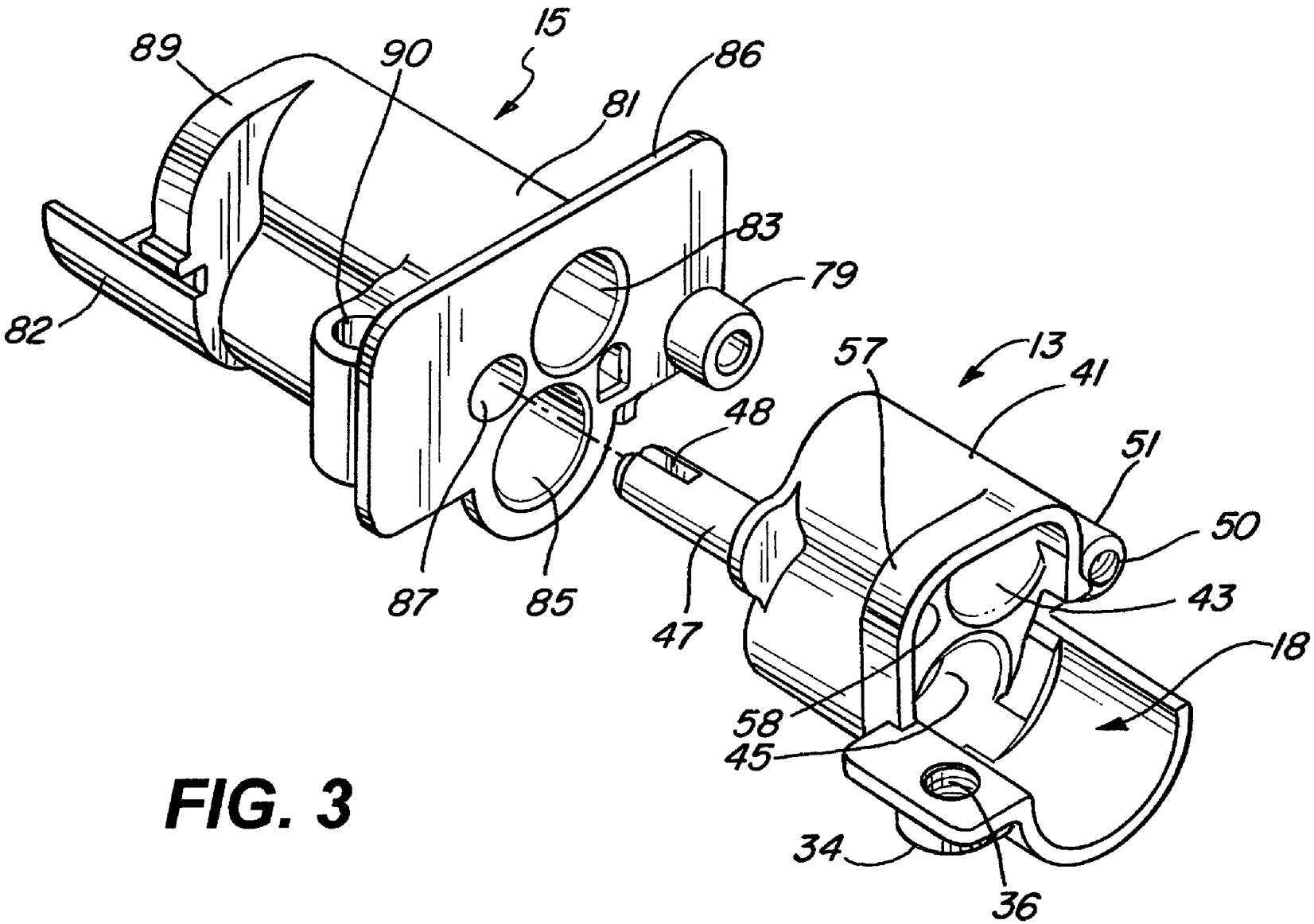
FIG. 3 is a front perspective view illustrating the female and male halves of the connector of FIG. 1.
Figure 4:
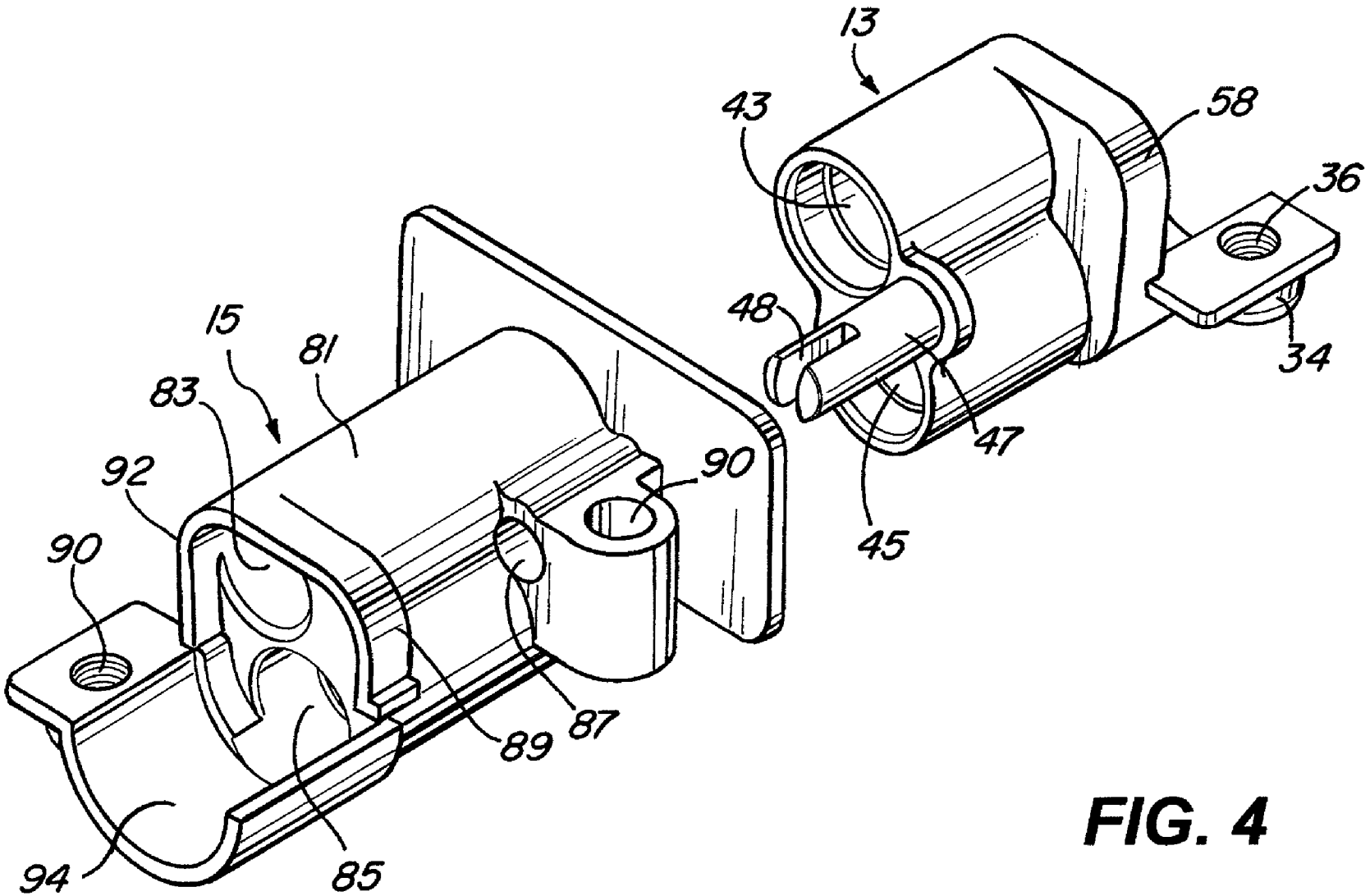
FIG. 4 is a rear perspective view illustrating the female and male halves of the connector of FIG. 1.

As shown in FIGS. 3-4, in an illustrative embodiment, the passageways 43, 45 of the connector half 13 are disposed above the semi-circularly curved entry way 18, which receives and positions the end 20 of the electrical conduit 23. The shaft of a thumbscrew 53 (FIG. 1) passes through an opening 50 in a cylindrical boss 51 on the male connector half 13 and threads into a boss 79 in the female connector half 15 to thereby attach the female connector half 15 to the male connector half 13 and secure electrical connection between them.

A rim 57 is formed around the periphery of the front end of the male connector half body 41. The inner face of the cover 31 abuts the front face 58 of this rim 57 to define an interior space, which, as noted above, accommodates fanning out of electrical leads into the two horizontally disposed passageways 43, 45. A horizontally extending ground pin 47 is formed at the rear of the body 41 of the male insert 13. The pin 47 is generally cylindrical and has a slot 48 formed in its far end. The slot 48 allows for some compression of the pin 47 to accommodate manufacturing tolerances.

In the embodiment shown in FIG. 1, the female connector half 15 is fixed in one end of a base member 17 of an electric lighting fixture 17 and has a generally rectangular face 86, which is preferably shaped and dimensioned to fill and close the opening in the end 19 of the base member 17. The female connector half 15 is preferably formed as a single piece having a central body portion 81 in which are formed respective horizontally disposed passageways 83, 85 whose circular openings may each be of the same diameter. A cylindrical female opening or through hole 87 is also formed in the body 81 to receive and make electrical contact with the ground pin 47 of the male connector half 13.

A screw 88 threads through an opening 90 (FIG. 3) behind the face plate 86 to attach the female connector half 15 to the light fixture base 17. The female connector half body 81 further has a rear flange or rim 89 formed thereon and a semi circular exit way 91. A second cover 80, which may be identical in shape to cover 31, is attached to the female connector half 15 by a screw 84, which threads into a rear portion 82 of the female connector half 15. The second cover 80 abuts the front face 92 of the rear flange 89, and covers the exit way 91, thereby providing a shielded, enclosed space to accommodate and shield electrical leads, e.g. 205, 207 (FIG. 9) which exit the female connector half 15.

Figure 5:
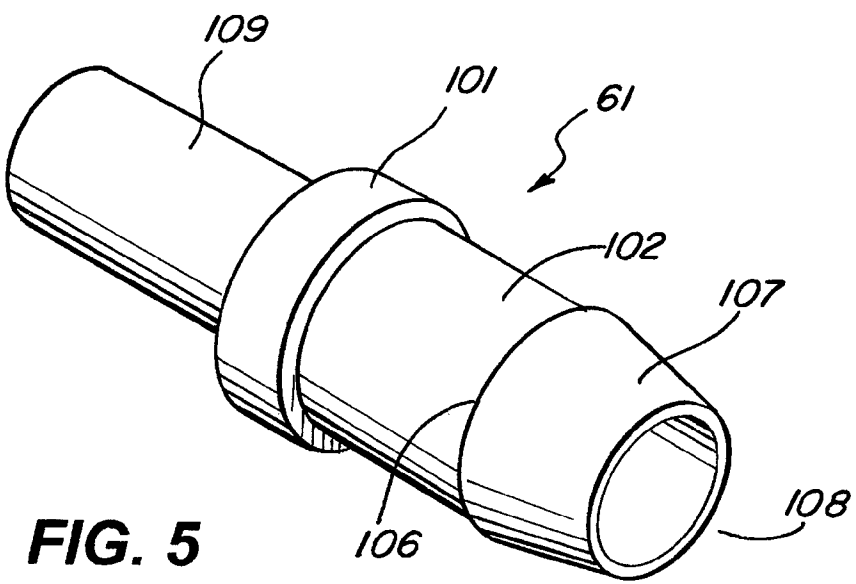
FIG. 5 is a perspective view of a female insert component.

According to one illustrative embodiment, an insulative male insert 61 as shown in FIG. 5 is dimensioned to fit into each of the passageways 43, 45 formed in the body 41 of the male connector half 13. This male insert 61 has a central cylindrical flange 101 formed on its outer surface. A tapered front flange 107 is additionally formed at the front end 108 of the male insert 61. A central cylindrical surface 102 of lesser diameter than the central flange 101 or the rear edge 106 of the tapered flange is positioned between those two flanges 101, 107. The rear end 109 of the male insert 61 comprises a tube having a cylindrical outer surface.

Figure 6:
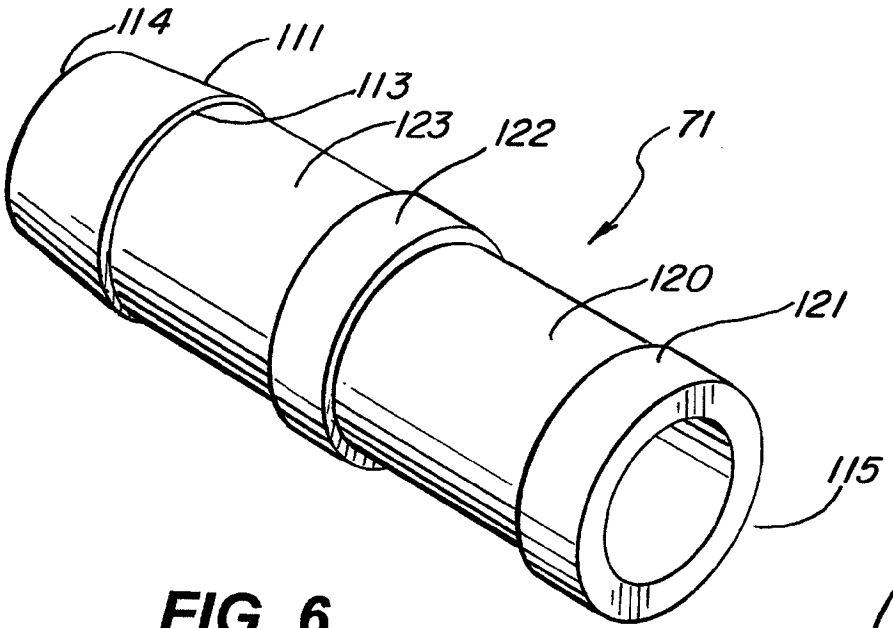
FIG. 6 is a perspective view of a male insert component.

Similarly, an insulative female insert 71 as shown in FIG. 6 is dimensioned to fit into each of the passageways 83, 85 in the female connector half 15. The female insert 71 has a central cylindrical flange 122 and a tapered rear flange 111, which tapers down from a vertical edge 113 to the outermost end 114 of the female insert 71. Additionally, the female insert 71 has a cylindrical flange 121 at its opposite end 115 and a cylindrical surface 120 of lesser diameter than the outer diameter of the flanges 121, 122 positioned between those two flanges 111, 122. A second cylindrical surface 123 is positioned between the rear flange 111 and the central flange 122 and is of lesser diameter than the central flange 122 and the rear edge 113 of the tapered rear flange 111.

Figure 7:
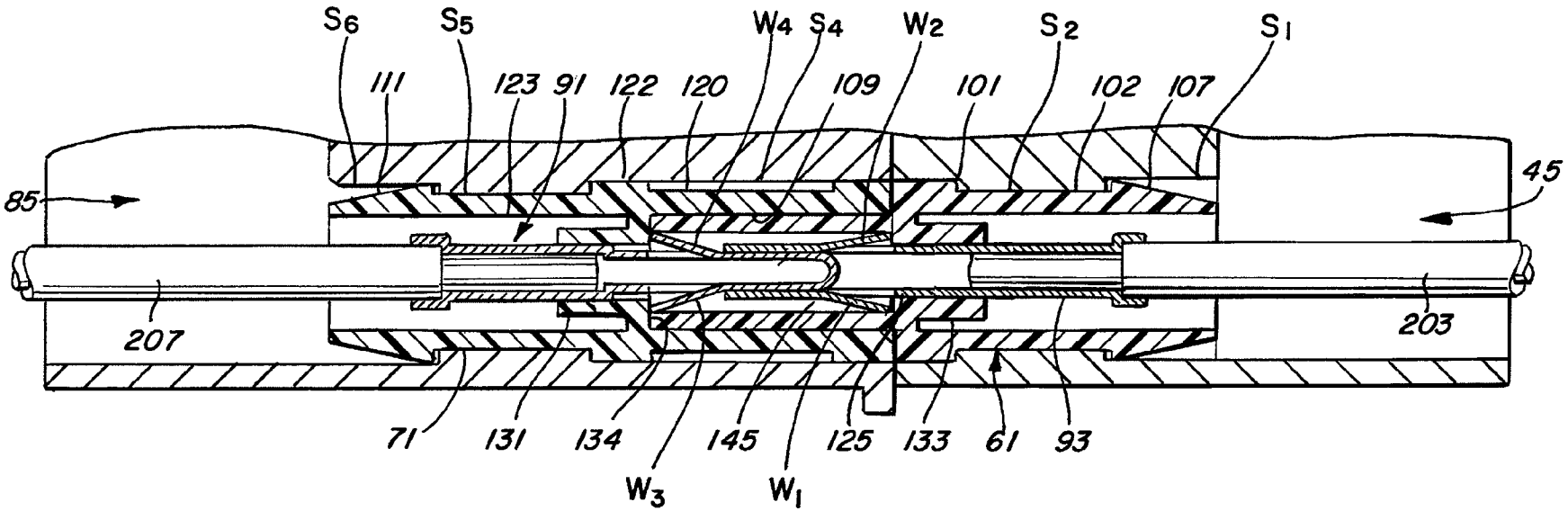
FIG. 7 is a partial cross-sectional view of the assembled connector.

FIG. 7 shows a cross-section through passageways 45 and 85 of an assembled connector 11 to further illustrate the structural relationships of the various components of the illustrative embodiment. As shown, each male insert 61 has an interior shaped and dimensioned to receive, position, and retain an electrically conductive female connector pin 93. Likewise, each female insert 71 has an interior shaped and dimensioned to receive, position, and retain an electrically conductive male connector pin 91. In the illustrative embodiment, each connector pin 91, 93 is retained in position by an inner mounting cylinder 131, 133 integrally molded within the interior of the respective inserts 71, 61. In one embodiment, the female and male connector pins 91, 93 may be standard AMP 600 volt connector pins and the inserts 61, 71 are unitary components molded or otherwise fabricated of nylon or other suitable materials.

As further shown in FIG. 7, the interior of the male connector half passageway 45 comprises three concentric cylindrical segments: a first cylindrical segment $S_1$ of a first diameter, followed by a second cylindrical segment $S_2$ of lesser diameter, which opens into a third cylindrical segment $S_3$ of larger diameter. The central cylindrical flange 101 of the male insert 61 mates with the third cylindrical segment $S_3$, the cylindrical surface 102 of the male insert 61 mates with the second cylindrical segment $S_2$, while the tapered front flange 107 of the female insert 61 resides in the first cylindrical segment $S_1$.

Similarly, the passageway 85 in the female connector half 15 comprises three concentric cylindrical segments: a first cylindrical segment $S_4$ of a first diameter, a second cylindrical segment $S_5$ of a second diameter less than the first diameter, and a third cylindrical segment $S_6$ of a third diameter greater than the second diameter 55. The tapered rear flange 111 of the female insert 71 resides in the third cylindrical segment $S_6$, the outer cylindrical surface 123 of the female insert 71 mates with the second cylindrical segment $S_5$, and the flanges 121, 122 of the female insert 71 reside in the first cylindrical segment $S_4$.

In assembly, the female connector pin 93 is pushed into the male insert 61, such that the wings W1, W2 of the connection pin 93 are compressed as the pin 93 passes through the interior cylinder 133 and then snap into the position shown in FIG. 7 where the wings W1, W2 lock the connector pin 93 in position within the male insert 61. Similarly, the interior of the female insert 71 includes an inner lip 132 of circular cross-section, which abuts the wings W3, W4 of the male connector pin 91 after the male connector pin 91 has been inserted from left to right into the female insert 71.

FIG. 7 further illustrates electrical leads (power wires) 203, 207 attached to the respective male and female connector pins 93, 91. The connector pins 93, 91 are positioned by the respective inserts 61, 71 to come into the mating relationship shown in FIG. 7 when the respective male and female connector halves 13, 15 are manually or otherwise pushed together.

Figure 9:
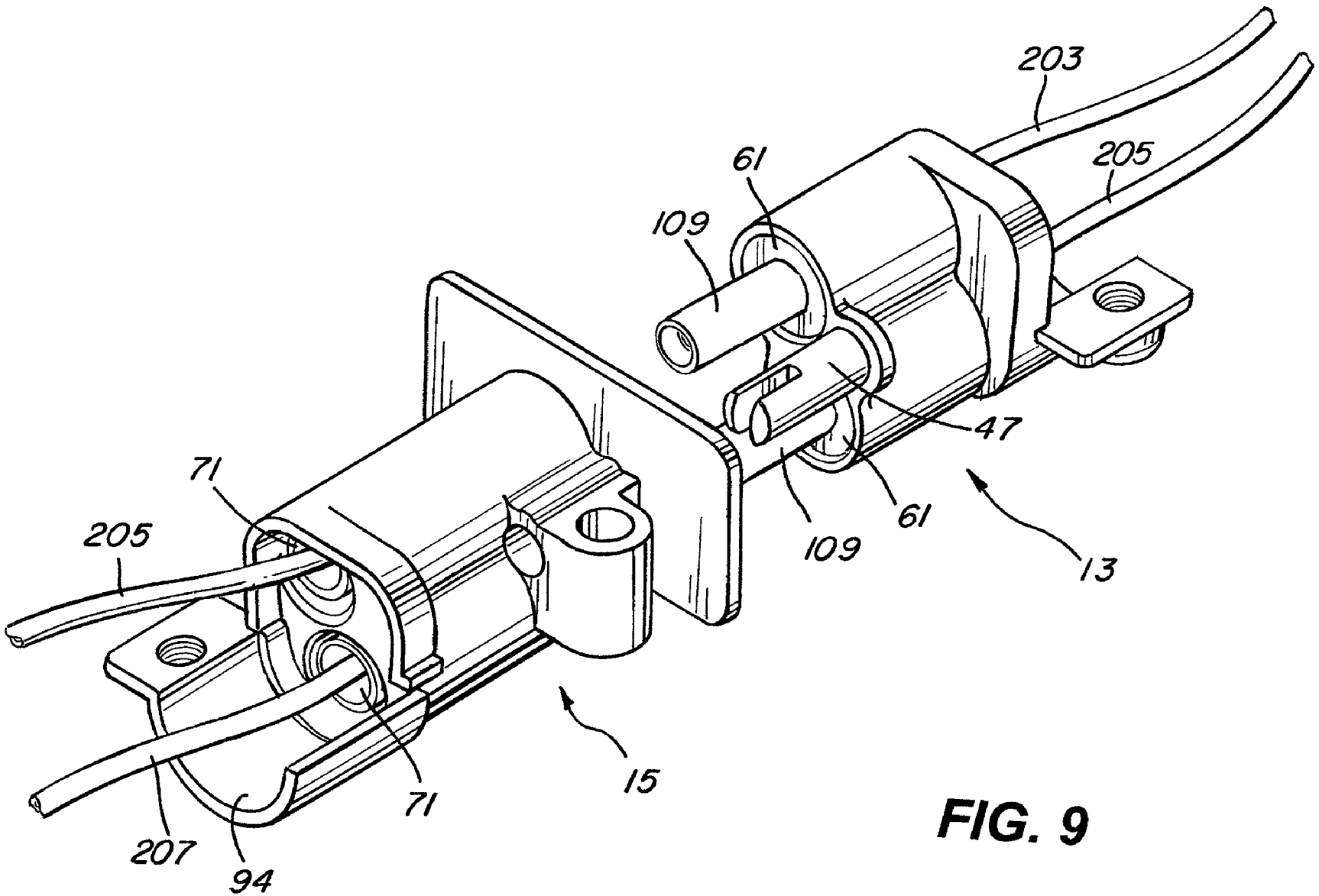

In assembling the connector 11, the male insert 61 is inserted into passageway 45 such that the flanged end 107 enters the third cylindrical segment $S_3$ of the passageway 45 and thereafter proceeds from left to right into the first cylindrical segment $S_1$ where the flange 107 snaps into place thereby positioning the tube or cylindrical end 109 of insert 61 to extend outside the male connector half body 41, as shown, for example, in FIG. 9. The female connector pin 93 with power wire 203 attached is thereafter inserted into the male insert 61, as described above.

Similarly, the female insert 71 is inserted into the passageway 85 such that the tapered end 111 of the insert 71 first enters the fourth cylindrical segment $S_4$ and thereafter travels leftwardly into the sixth cylindrical segment $S_6$ where the tapered end 111 snaps into place within that cylindrical segment $S_6$. The male connector pin 91 with power wire 207 attached is thereafter inserted into the female insert 71, as described above.

As noted above, FIG. 7 illustrates one pair of passageways 45, 85 communicating with one another. In the illustrative embodiment, the other pair of passageways 43, 83 may have a cross-section which is identical to that shown in FIG. 7.

Figure 8:
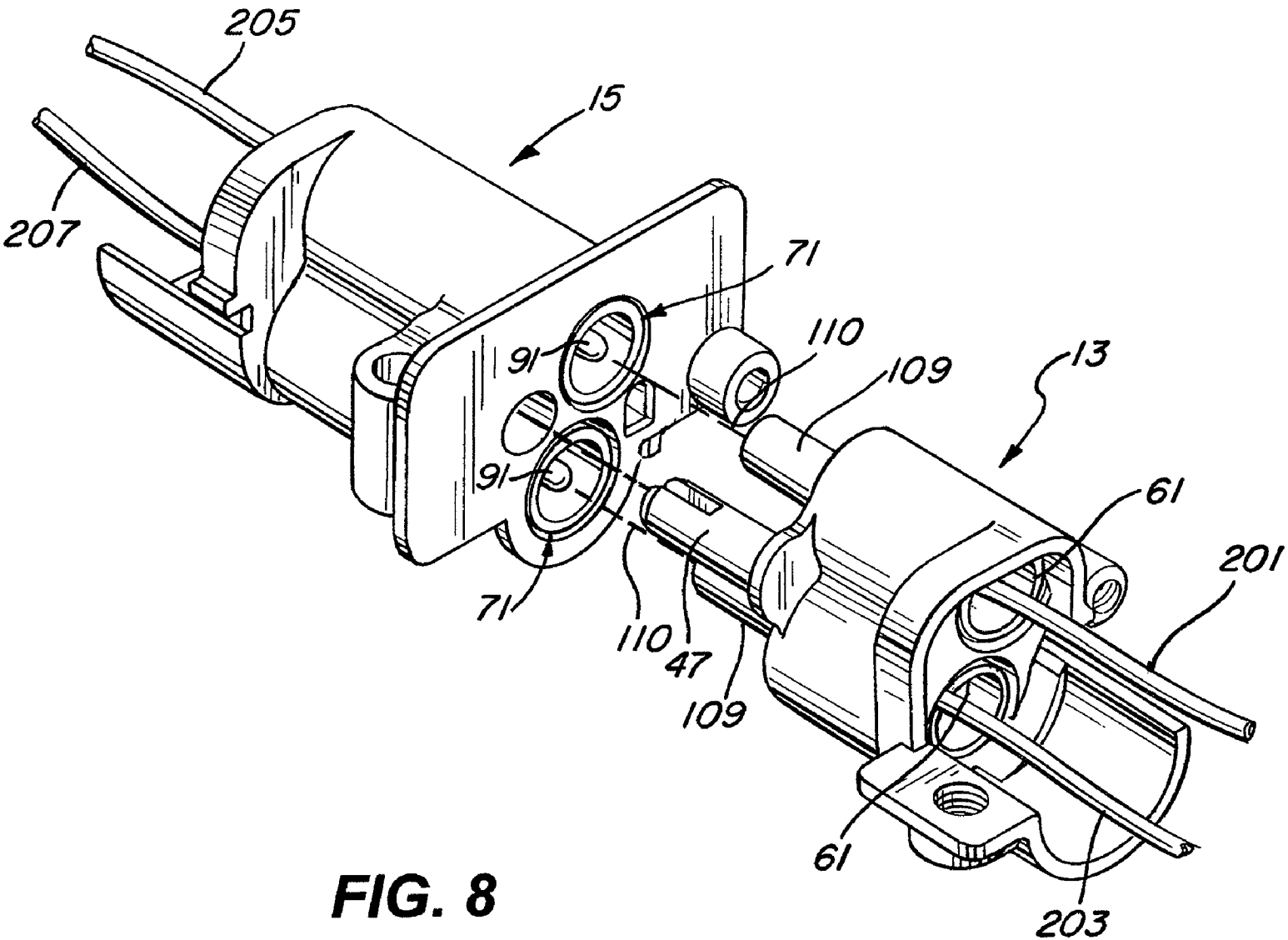
FIGS. 8 and 9 are respective front and rear perspective views illustrating the male and female connector halves with the male and female inserts installed therein.

FIGS. 8 and 9 show the connector halves 13, 15 with the male and female inserts 61, 71 installed therein. As seen, the tubes 109 on the male insert 61 are concentrically aligned on respective central horizontal axes 110 with the female inserts 71 such that the male connector half 13 may be manually or otherwise plugged into the female connector half 15. In the illustrative embodiment, the length of the ground pin 47 is selected such that, during insertion of the male connector half 13 into the female connector half 15, a ground connection is established before electrical contact occurs between the contact pins 91, 93. As a result, when the connector halves 13, 15 are unplugged from one another, the ground connection is broken before electrical contact between the connector pins 91, 93 is broken.

As noted above, in one embodiment, the connector halves 13, 15 may be fabricated of aluminum, while the male and female inserts 71, 61 are molded of nylon. Various other metals, composites, and/or plastics could be used to form these parts in various embodiments. Thus, those skilled in the art will appreciate that various adaptations and modifications of the just described embodiments can be configured without departing from the scope and spirit of the invention. Therefore, it is to be understood that, within the scope of the appended claims, the invention may be practiced other than as specifically described herein.

What is claimed is:

1. An electrical connector comprising:

a female connector half comprising a solid body with first and second horizontally disposed passageways formed therein and a ground pin receptacle;

a male connector half comprising a solid body with first and second horizontally disposed passageways formed therein and a horizontally extending ground pin;

the female connector half being adapted to mate with the male connector half;

the first and second passageways of the female connector half each being aligned with a respective one of the first and second passageways of the male connector half so as to form first and second continuous passageways through the male and female connector halves when the male and female connector halves are mated together;

a first female insert positioned in the first of the passageways of said female connector half, said first female insert having an interior passageway shaped and dimensioned to receive and retain a first electrical connector pin;

a first male insert positioned in the first passageway of said male connector half aligned with the first passageway of said female connector half, said first male insert having an interior passageway shaped and dimensioned to receive and retain a second electrical connector pin adapted to mate with said first electrical connector pin;

the female insert having a cylindrical opening in a first end thereof which receives and positions a mating cylindrical portion of said male insert when the first connector half mates with the female connector half;

the first and second electrical connector pins being so positioned respectively in the female and male inserts that they interconnect when the male connector half mates with the female connector half; and the ground pin and ground pin receptacle further being so positioned and dimensioned that they mate to establish a ground when the male connector half mates with the female connector half.

2. The electrical connector of claim 1 wherein the female and male connector halves are each fabricated of a selected metal.

3. The electrical connector of claim 2 wherein said metal is aluminum.

4. The electrical connector of claim 2 wherein the male and female inserts are each fabricated of plastic.

5. The electrical connector of claim 4 wherein the plastic is nylon.

6. The electrical connector of claim 1 wherein the male insert has a tapered front flange which tapers down from a vertical edge to an outermost end, a cylindrical tube at its opposite end, a central cylindrical flange, and a central cylindrical surface of lesser diameter than the outer diameter of the central cylindrical flange and of lesser diameter than a circular rear edge of the tapered front flange, the central cylindrical surface being positioned between the central cylindrical flange and the tapered front flange.

7. The electrical connector of claim 6 wherein the female insert has a central cylindrical flange formed on its outer surface, a tapered rear flange formed at a rear end, a front flange, a cylindrical surface of lesser diameter positioned between the central flange and the tapered rear flange and a cylindrical outer surface formed between said central flange and front flange having a diameter less than that of said central and front flanges.

8. The electrical connector of claim 7 wherein the passageway of the female connector half comprises three concentric cylindrical segments: a first cylindrical segment of a first diameter followed by a second cylindrical segment of lesser diameter, which opens into a third cylindrical segment of larger diameter.

9. The electrical connector of claim 8 wherein the central cylindrical flange of the female insert is positioned within the third cylindrical segment, the cylindrical surface of lesser diameter of the female insert mates with the second cylindrical segment and the tapered front flange of the female insert resides in the first cylindrical segment.

10. The electrical connector of claim 9 wherein the passageway in the male connector half comprises three concentric cylindrical segments: a fourth cylindrical segment of a first diameter, a fifth cylindrical segment of a second diameter less than the first diameter and a sixth cylindrical segment of a third diameter greater than the second diameter.

11. The electrical connector of claim 10 wherein the tapered front flange of the male insert resides in the sixth cylindrical segment, the central cylindrical surface of the male insert resides in the fifth cylindrical segment, and the central cylindrical flange of the male insert resides in the fourth cylindrical segment.

12. An electrical connector comprising:

a first connector half comprising a solid body with first and second horizontally disposed passageways formed therein and a ground pin receptacle;

a second connector half comprising a solid body with first and second horizontally disposed passageways formed therein and a horizontally extending ground pin;

the first connector half being adapted to mate with the second connector half;

the first and second passageways of the first connector half each being aligned with a respective one of the first and second passageways of the second connector half so as to form first and second continuous passageways through the first and second connector halves when the first and second connector halves are mated together;

a first insert positioned in the first of the passageways of said first connector half, said first insert having an interior passageway shaped and dimensioned to receive and retain a first electrical connector pin;

a second insert positioned in the first passageway of said second connector half aligned with the first passageway of said first connector half, said second insert having an interior passageway shaped and dimensioned to receive and retain a second electrical connector pin adapted to mate with said first electrical connector pin;

the first insert having a cylindrical opening in a first end thereof which receives and positions a mating cylindrical portion of said second insert when the second connector half mates with the first connector half;

the first and second connector pins being so positioned respectively in the first and second inserts that they interconnect when the first connector half mates with the second connector half; and the ground pin and ground pin receptacle further being so positioned and dimensioned that they mate to establish a ground when the second connector half mates with the first connector half.

13. The electrical connector of claim 12 wherein the first and second connector halves are each fabricated of a selected metal.

14. The electrical connector of claim 13 wherein said metal is aluminum.

15. The electrical connector of claim 13 wherein the first and second inserts are each fabricated of plastic.

16. The electrical connector of claim 15 wherein the plastic is nylon.

17. The electrical connector of claim 12 wherein the second insert has a tapered front flange which tapers down from a vertical edge to an outermost end, a cylindrical tube at its opposite end, a central cylindrical flange, and a central cylindrical surface of lesser diameter than the outer diameter of the central cylindrical flange and of lesser diameter than a circular rear edge of the tapered front flange, the central cylindrical surface being positioned between the central cylindrical flange and the tapered front flange.

18. The electrical connector of claim 17 wherein the first insert has a central cylindrical flange formed on its outer surface, a tapered rear flange formed at a rear end, a front flange, a cylindrical surface of lesser diameter positioned between the central flange and the tapered rear flange and a cylindrical outer surface formed between said central flange and front flange having a diameter less than that of said central and front flanges.

19. The electrical connector of claim 18 wherein the passageway of the first connector half comprises three concentric cylindrical segments: a first cylindrical segment of a first diameter followed by a second cylindrical segment of lesser diameter, which opens into a third cylindrical segment of larger diameter.

20. The electrical connector of claim 19 wherein the central cylindrical flange of the first insert is positioned within the third cylindrical segment, the cylindrical surface of lesser diameter of the first insert mates with the second cylindrical segment and the tapered front flange of the first insert resides in the first cylindrical segment.

21. The electrical connector of claim 20 wherein the passageway in the second connector half comprises three concentric cylindrical segments: a fourth cylindrical segment of a first diameter, a fifth cylindrical segment of a second diameter less than the first diameter and a sixth cylindrical segment of a third diameter greater than the second diameter.

22. The electrical connector of claim 21 wherein the tapered front flange of the second insert resides in the sixth cylindrical segment, the central cylindrical surface of the second insert resides in the fifth cylindrical segment, and the central cylindrical flange of the second insert resides in the fourth cylindrical segment.

23. The electrical connector of claim 1 wherein the length of the ground pin is selected such that, during insertion of the male connector half into the female connector half, a ground connection is established before electrical contact occurs between the first and second electrical connector pins.

24. The electrical connector of claim 12 wherein the length of the ground pin is selected such that, during insertion of the second connector half into the first connector half, a ground connection is established before electrical contact occurs between the first and second electrical connector pins.

25. The electrical connector of claim 1 further comprising a thumb screw for attaching the male and female connector halves to one another.

26. The electrical connector of claim 12 further comprising a thumb screw for attaching the first and second connector halves to one another.

27. The electrical connector of claim 1 further comprising a receptacle of semicircular contour positioned at a front end of the male connector half for receiving a first end of an electrical conduit.

28. The electrical connector of claim 27 wherein a first end of the electrical conduit is held in place in the receptacle by a cover or conduit clamp, which is attachable to the male connector half.

29. The electrical connector of claim 12 further comprising a receptacle of semicircular contour positioned at a front end of the second connector half for receiving a first end of an electrical conduit.

30. The electrical connector of claim 29 wherein a first end of the electrical conduit is held in place in the receptacle by a cover or conduit clamp, which is attachable to the second connector half.

* * * * *